United States Patent [19]

Bayless

[11] Patent Number: 4,470,276

[45] Date of Patent: Sep. 11, 1984

[54] LOCK FOR DOUBLE DOORS

[76] Inventor: James D. Bayless, 412 S. Bellaire, Kansas City, Mo. 64123

[21] Appl. No.: 406,483

[22] Filed: Aug. 9, 1982

[51] Int. Cl.[3] ..... E05B 65/00

[52] U.S. Cl. ..... 70/91; 70/118; 70/DIG. 42; 70/DIG. 65; 70/380; 292/37; 292/DIG. 21

[58] Field of Search ..... 70/91, 101, 107, 379 R, 70/380, DIG. 42, DIG. 65, 113, 118, 119, 120; 292/37, 40, DIG. 21, DIG. 62; 49/61, 63, 65

[56] References Cited

U.S. PATENT DOCUMENTS 1,495,820 5/1924 Tierney ..... 292/DIG. 62

2,381,666 8/1945 Hinton ..... 70/DIG. 65

*Primary Examiner*—Robert L. Wolfe

*Attorney, Agent, or Firm*—John Hamilton

[57] ABSTRACT

A lock for a pair of doors hung in a single door frame, usually an inner main door and an outer door which may be a storm door and usually includes glass or screen panels through which a caller may be observed and identified, the lock including a pair of bolts carried by the door frame and operable to be extended therefrom to engage sockets formed therefor respectively in the door edges to secure them against opening. The bolts are operated by a lock shaft carried in the door frame to unlock first the inner door, so that it may be opened to permit observation and identification of a caller, while the outer door remains locked, and then to unlock the outer door if desired, to permit ingress of the caller. The lock shaft may be operated from inside the doors by a manual lever, and from outside by a key mechanism.

9 Claims, 10 Drawing Figures

LOCK FOR DOUBLE DOORS

Figure 1:
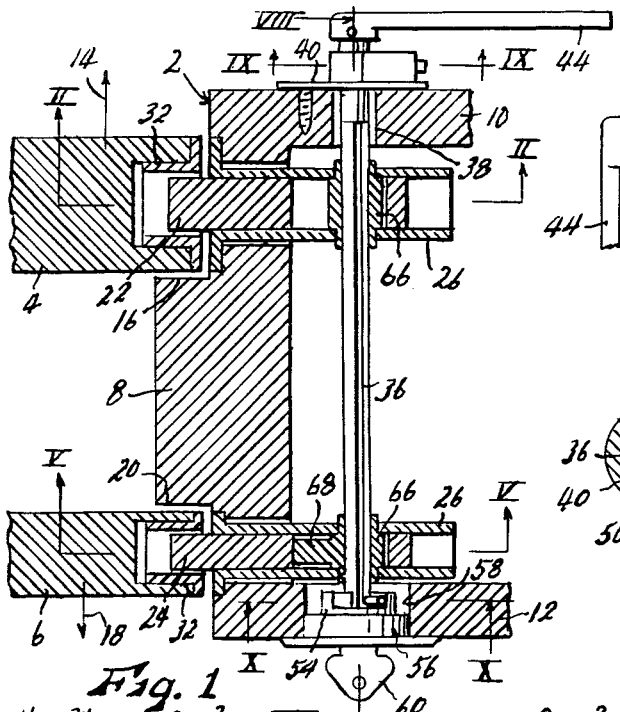

This invention relates to new and useful improvements in door locks, and has particular reference to a lock for the double doors with which houses and apartments are commonly furnished. The double doors include a main door, usually the inner of the two doors, and an outer door, which in the case of homes is usually a storm door, and in the case of apartments may be a "security" door. In either case, the outer door usually includes glass or screen panels, for visibility and/or ventilation when the inner door is open, and sometimes small openings through which small objects may be passed with no necessity for unlocking or opening said outer door.

The principal object of the present invention is the provision of a lock mechanism for double doors of the class described which offers greater convenience and security to the occupant of the dwelling.

More specifically, it is an object of the present invention to provide a lock mechanism whereby the dwelling occupant, by operation of a single control, may first unlock the inner door, to permit opening thereof to observe and identify a caller, while the outer door remains locked, and then unlock the outer door if it is desired to admit the caller. The mechanism may be controlled, for example, by a manually moveable lever from within the dwelling, and by a key mechanism from outside the dwelling, so that only persons having possession of the proper key may gain access from the outside.

Another object is the provision of a double door lock of the character described in which each of the doors is locked by an individual bolt, both of the bolts, as well as the operating mechanism therefor, being mounted in the door frame, rather than in the doors themselves. This eliminates any necessity for direct operational connections between the doors themselves, as is often the case in existing double door locks, and also eliminates necessity, also often required in existing double door locks, of reclosing the inner door, after it has been opened and the caller identified, in order to latch it to the outer door, and then to unlock the outer door so that both doors may then be opened. Prior door locks of this class also often require that both doors open in same direction and on a common hinge axis, which is inconvenient and contrary to common practice. The present double door lock does not make this requirement.

A further object of the provision of a double door lock of the character described including a pair of bolts mounted slidably in the door frame adjacent the doors, each being extendable to engage in a socket formed in the edge of one of the doors to lock said door, and retractable to unlock said door, and operating means for said bolts whereby the locking, and unlocking of the doors is always properly sequenced, that is, such that the inner door is unlocked before the outer door, and the outer door is locked before the inner door.

A still further object is the provision of a double door lock of the character described having means providing that the outer door, when locked, is alway dead bolted, for added security.

Other objects are simplicity and economy of structure, and efficiency and dependability of operation.

Figure 2:
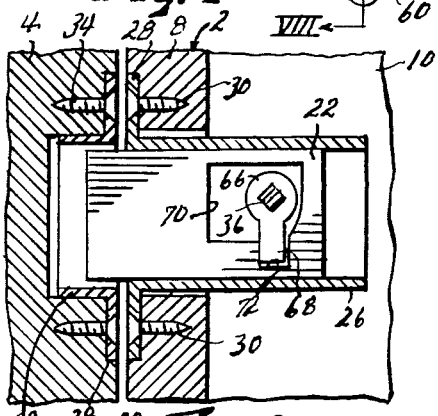
Figure 3:
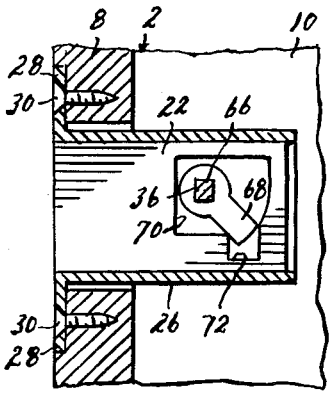

With these objects in view as well as other objects which will appear in the course of the specification, reference will be had to the accompanying drawing, wherein:

FIG. 1 is a fragmentary horizontal sectional view through the edge portions of a pair of double doors and adjacent portions of the door frame in which said doors are mounted, and showing a lock mechanism embodying the present invention operatively installed therein, both doors being shown locked, FIG. 2 is a fragmentary sectional view taken on line II—II of FIG. 1, with parts left in elevation, FIG. 3 is a view similar to FIG. 2 but showing the position of the inner door bolt and its operating parts when the inner door is unlocked, but the outer door remains locked.

Figure 8:
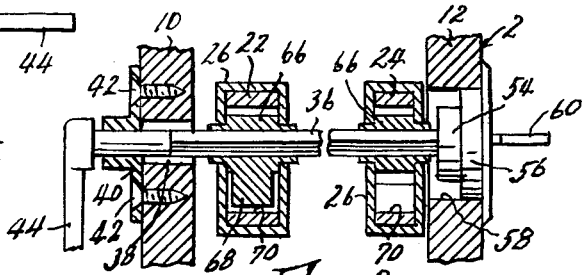
Figure 9:
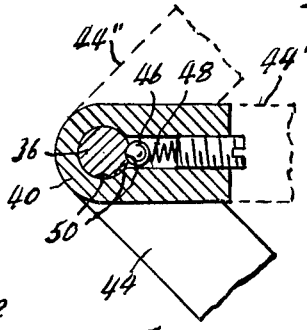
Figure 10:
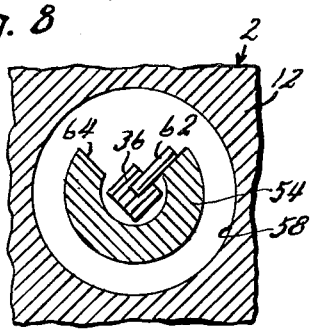
Figure 4:
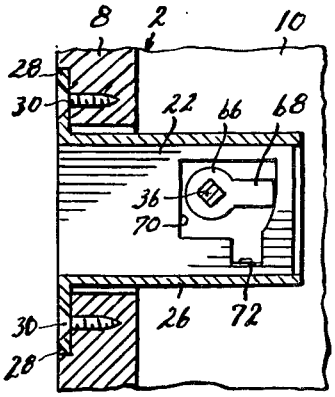
Figure 5:
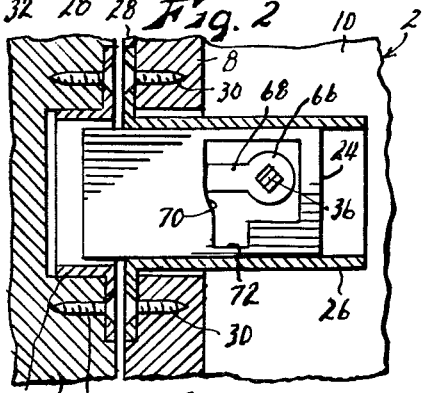
Figure 6:
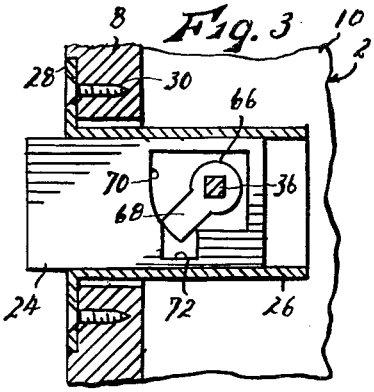
Figure 7:
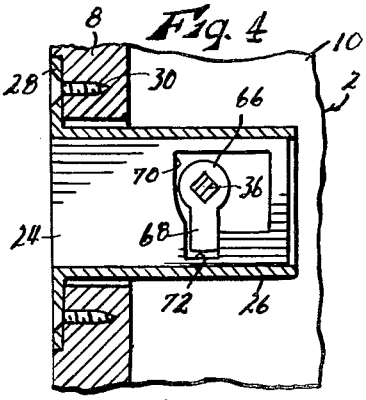

FIG. 4 is a view similar to FIG. 3, but showing the position of the parts when both doors are unlocked, FIG. 5 is a fragmentary sectional view taken on line V—V of FIG. 1, FIG. 6 is a view similar to FIG. 5 but showing the position of the outer door bolt and its operating parts when the inner door is unlocked but the outer door remains locked, FIG. 7 is a view similar to FIG. 6 but showing the position of the parts when both doors are unlocked, FIG. 8 is a fragmentary, foreshortened sectional view taken on line VIII—VIII of FIG. 1, FIG. 9 is an enlarged, fragmentary sectional view taken on line IX—IX of FIG. 1, showing alternative positions of the inner operating lever in dotted lines, and FIG. 10 is an enlarged, fragmentary sectional view taken on line X—X of FIG. 1.

Like reference numerals apply to similar parts throughout the several views, and the numeral 2 applies generally to a door frame, shown fragmentarily in horizontal section in FIG. 1, and in which an inner door 4 and an outer door 6 are hung in the usual manner. Only the movable edge portions of the doors and the immediately adjacent portions of the door frame are shown. It will be understood that the opposite edges of the doors are hinged in the frame, each on its own hinge axis. Door frame 2 includes a face panel 8 confronting the movable edges of the doors, and inner and outer panels 10 and 12 connected to the face panel and lying parallel to the normal planes of the doors. Inner door 4 opens inwardly, as indicated by arrow 14 in FIG. 1, and closes against a shoulder 16 provided by frame face panel 8. Outer door 6 opens outwardly, as indicated by arrow 18, and closes against a shoulder 20 also provided by panel 8. The structure thus far described is normal and customary.

The lock mechanism contemplated by the present invention includes a pair of lock bolts 22 and 24 carried in door frame panel 8, respectively aligned with the normal planes of doors 4 and 6, when said doors are closed. Each of said bolts, as shown, comprises an elongated flat bar of rectangular cross sectional contour, slidable longitudinally in a sheet metal tubular guide 26 set into the exposed surface of frame panel 8, and provided with tabs 28 countersunk into the face of panel 8 and affixed thereto by screws 30. Said bolt is aligned with the plane of its associated door, when said door is closed, and is slidable horizontally in its guide 26 to be extended into a socket member 32 set into the edge of its associated door 4 or 6, said socket member being similarly secured in the door by screws 34, whereby to lock the door positively against any opening movement, as shown in FIGS. 1, 2, 5 and 6. The bolts may of course also be retracted within their tubular guides 26 till their outer ends are flush with the face of frame panel 8, as shown in FIGS. 3, 4 and 7, whereby the doors are unlocked and freed for opening movement.

Bolts 22 and 24 are operated by means including a lock shaft 36 extending horizontally through door frame 2 normally to the door plane, and spaced inwardly from frame face panel 8. At its inner end, said shaft passes through a bore 38 formed in inner frame panel 10, is journalled rotatably in the hub of a fascia plate 40 fixed to panel 10 by screws 42, and has a radially extending lever 44 affixed to its extended end. The hub of fascia plate 40 is radially bored to receive a detent ball 46 urged by a spring 48 to engage one of a series of three angularly spaced sockets 50 formed in shaft 36, depending on the angular position of shaft 36 and lever 44. Said sockets are disposed at 45 degree intervals (see FIG. 9). The portion of shaft 36 between inner and outer frame panels 10 and 12 is of square or otherwise non-circular cross sectional contour. It extends through tubular guides 26 of lock bolts 22 and 24 to operate said bolts, as will be described hereinbelow, and is journalled at its outer end in a socket 52 formed axially in the rotatable barrel 54 (see FIG. 10) of a key lock mechanism. Said barrel is rotatable, coaxially with shaft 36, in a lock body member 56 which is affixed immovably by any suitable means, not shown, in a bore 58 of outer frame panel 12, and may be turned only by a proper key 60 inserted into its outer end, as is common in the art. Within the barrel socket 52, a short pin 62 is fixed in shaft 36, and extends radially therefrom into an angular notch 64 formed in the barrel wall. The angular extent of said notch is such as to permit 90 degrees of lost motion between the barrel and shaft.

Shaft 36 extends through tubular bolt guides 26. Within each guide, it projects slidably but non-rotatably through the hub 66 of a radial cam lever 68 disposed entirely within the guide. Hubs 66 are journalled in the walls of the slide to hold the cam levers in assembly, in order that shaft 36 may be inserted after the slides and bolts have been mounted in the door frame. Within each slide, the cam lever 68 is disposed within a cut-out window 70 of the associated bolt 22 or 24. Said windows are generally rectangular, being of sufficient size as to permit a 90 degree movement of the cam lever therein, and is provided at its lower edge with a narrower open notch 72 just wide enough to receive the outer end of said cam lever. The windows 70 of the two bolts are mirror images of each other, and the respective cam levers 68 are spaced 90 degrees apart relative to shaft 36.

In operation, it will be seen that FIGS. 1, 2, 5 and 8 show the position of the parts when both of bolts 22 and 24 are extended to lock both the inner and outer doors 4 and 6. Whenever lock shaft 36 is turned 45 degrees in a counterclockwise direction, as viewed in FIGS. 2 and 5 either by means of lever 44 from inside the dwelling, or by inserting and turning key 60 from outside the dwelling, bolt 22 of the inner door is retracted to unlock said door, by the camming action of its cam lever 68 against the side of notch 72 of said bolt. At this moment, its cam lever escapes from notch 72, so that shaft 36 may be turned another 45 degrees in the same direction without further retraction of bolt 22. As will be seen from FIGS. 5–7, the first 45 degrees of movement of shaft 36 does not retract bolt 24 of the outer door, since its cam lever 68 does not engage its notch 72 during this movement. Therefore, after the first 45 degree turn of the shaft, the inner door is unlocked while the outer door remains locked, and the dwelling occupant may open the inner door to observe, identify and possibly converse with the caller. If he decides to admit the caller, he then turns shaft 36 through its second 45 degree movement, so that cam lever 68 of bolt 24 engages in its notch 72 to retract said bolt to unlock the outer door, as shown in FIG. 7. Both doors are then unlocked, and may be opened to admit the caller. The doors are of course re-locked by reversing the turning movement of shaft 36, the outer door being locked first, and the inner door last, as will be obvious from a consideration of FIGS. 2–7. It will be noted in FIG. 5 that the outer door, when locked, is always "deadbolted", that is, its cam lever 68 is disposed to act as a positive strut between the bolt and shaft 36, so that said bolt cannot be retracted by any external force applied thereto, short of actual destruction of the parts. This feature provides added security.

Detent ball 46 provides a positive indication to the dwelling occupant of the condition of the bolts, and holds lever 44 releasably in the position desired. This is particularly desireable in indicating to him when the inner door is unlocked but the outer door is locked, which occurs at position 44′ of lever 44 (see FIG. 9) in order that he will not move it to position 44″, at which both doors are unlocked, by accident. The engagement of shaft pin 62 in angular notch 64 of lock barrel 54 permits free turning of the shaft by lever 44, as required, when the proper key 60 has not been inserted and the barrel therefore cannot be turned. This lost motion can be compensated for, when operating the locks by key, by "overturning" the key to take up the slack. Police and other security experts sometimes recommend that locks be operable only by key, even from inside a dwelling. This is to prevent an intruder from breaking relatively small holes in the doors, which may contain some very thin panels, or glass or screen panels, then reach through the holes to operate the locks manually, as by turning lever 44. This recommendation may be subject to question, since it creates the possibility that the occupant may be locked in during a fire or other emergency, but the present device may easily be supplied with a key mechanism in substitution for lever 44, which would be identical to that shown at the outer side of the door frame, except of course that no lost motion between it and shaft 36 would be required. The doors may of course also be provided with the usual doorknobs and spring latches, not shown.

While I have shown and described a specific embodiment of my invention, it will be readily apparent that many minor changes of structure and operation could be made without departing from the spirit of the invention.

What I claim as new and desire to protect by Letters Patent is:

1. A lock mechanism for a double door arrangement including an inner door and an outer door mounted in a single door frame, the free edges of said doors moving generally normally to their planes to open and close, said mechanism comprising:

a. a pair of bolts mounted in said door frame adjacent the free edges of said doors and movable relative to said frame to be extended from said frame in a direction parallel to the planes of said doors, when they are closed, to engage in sockets provided therefor in the respective edges of said doors whereby said doors are locked, or to be retracted within said frame to unlock said doors, and b. manually operable means carried by said frame and operable to move said bolts between their extended and retracted positions.

2. A lock mechanism as recited in claim 1 wherein said operating means includes a manually movable member operable by movement in one direction, when said bolts are extended to lock both doors, to retract the bolt of said inside door while leaving the bolt of the outer door extended, during the first portion of said movement, and to retract the bolt of said outer door during the second portion of said movement, whereby said doors may be unlocked only in this sequence.

3. A lock mechanism as recited in claim 2 wherein said operating means is operable by a reverse movement of said manually movable member to extend said bolts to relock said doors in a reverse sequence.

4. A lock mechanism as recited in claim 1 wherein said operating means comprises:

a. a rotatable lock shaft extending horizontally through said door frame normally to the door plane, b. means connecting intermediate points of said lock shaft operably to the respective bolts, whereby rotary movement of said shaft will extend and retract said bolts, and c. manual means operable to turn said lock shaft.

5. A lock mechanism as recited in claim 4 wherein said means connecting said lock shaft to the respective bolts are offset angularly relative to said shaft, and also have periods of lost motion relative to said bolts, so arranged that on turning of said shaft in one direction from a position in which both bolts are extended, the bolt of said inner door is retracted before the bolt of said outer door is retracted.

6. A lock mechanism as recited in claim 4 wherein said means connecting said lock shaft to each of the respective bolts comprises a radial cam lever affixed to said shaft and operable to engage a notch formed therefor in the associated bolt during only one-half of a pre-determined degree of angular motion of said shaft, whereby to extend or retract said bolt responsively to turning of said shaft, depending on the direction of shaft movement, and to be disengaged from said notch during the other one-half of said pre-determined degree of angular shaft movement, said cam levers being angularly offset relative to said lock shaft by a degree equal to the total pre-determined angular movement of said shaft, whereby during either extension or retraction of said bolts by turning of said shaft in respectively opposite directions, the movement of one bolt is initiated and completed before movement of the other bolt is initiated, the sequence being such that during retraction of the bolts to unlock the doors the inner door bolt is retracted before that of the outer door.

7. A lock mechanism as recited in claim 6 with the addition of a spring detent operable to secure said lock shaft releasably in a position during either extension or retraction of said bolts, at which one of said bolts has been removed, but not the other bolt.

8. A lock mechanism as recited in claim 4 wherein said means for turning said lock shaft includes a manual lever affixed to the inner end of said shaft adjacent the inner side of said door frame.

9. A lock mechanism as recited in claim 8 wherein said means for turning said lock shaft also includes a key mechanism mounted at the outside of said door frame and connected to the outer end of said lock shaft, said key mechanism being operable to turn said shaft only after insertion of the proper key therein, the connection between said key mechanism and said shaft having a sufficient degree of lost motion that said shaft may be turned through a pre-determined degree of operating angular movement when no key has been inserted in said key mechanism.

* * * * *